US006425952B1

(12) United States Patent
Krapivner

(10) Patent No.: US 6,425,952 B1
(45) Date of Patent: Jul. 30, 2002

(54) DEVICE FOR APPLYING MORTAR ON A WORKABLE SURFACE

(76) Inventor: Vladimir Krapivner, 55 Ben Yehuda str., Tel Aviv-Jaffa (IL), 63431

( * ) Notice: Subject to any disclaimer, the term of this patent is extended or adjusted under 35 U.S.C. 154(b) by 0 days.

(21) Appl. No.: 09/525,252

(22) Filed: Mar. 13, 2000

(51) Int. Cl.[7] ..... B05C 5/02; E04G 21/04

(52) U.S. Cl. ..... 118/300; 118/407; 222/611.2

(58) Field of Search ..... 118/300, 407; 404/107, 111, 112, 113, 114, 115, 133.1; 222/611.2, 611.1

(56) References Cited

U.S. PATENT DOCUMENTS 3,790,201 A * 2/1974 Morsilli
4,266,686 A * 5/1981 Carter
4,753,471 A * 6/1988 Gringer
5,039,249 A * 8/1991 Hansen et al. ..... 404/114
5,186,507 A * 2/1993 Neidfeld
5,372,452 A * 12/1994 Hodgson ..... 404/112
5,449,406 A * 9/1995 Presti, Jr. ..... 118/264

* cited by examiner

*Primary Examiner*—Laura Edwards

(57) ABSTRACT

Device for applying mortar an a workable surface of a building comprises a common mobile base with a capacity for mortar, a pump with an electric drive, a hose and a changeable working organ. In the variant with semi-automatic control it comprises a microprocessor system of control and a panel on the mobile base, and outside the base there is a remote control panel and an autonomous micro-processor laser guidance unit for controlled supports of the working organ for its positioning and setting up applied mortar thickness. Supports are positioned on a movable frame connected to a carrying frame fixed on the common mobile base.

10 Claims, 9 Drawing Sheets

A-A
A
A
2
8
4
7
5
3
6
1

DEVICE FOR APPLYING MORTAR ON A WORKABLE SURFACE

BACKGROUND OF THE INVENTION

The present invention relates to the field of construction and refers to means used for decorating, building and repairs; it is intended for spackling and plastering, primarily for walls of the buildings.

There are two main methods (and accordingly two kinds of devices for its achievement) for applying motor on the surfaces to be plastered—manual process and mechanical process.

Manual process, which uses different appliances for applying plaster and leveling of the surface to be plastered, is extremely labour-consuming and of low efficiency (e.g. Israeli Patent No. 37094, 1971, Int. Cl. E 04 F 21/06). Other known manual appliances for the same purposes are not more convenient and efficient, (see, e.g., "Spackling tool with tool holders", U.S. Pat. No. 5,186,507, 1993, U.S. Cl. 294/3.5, hit. Cl. E 04 G 21/10, as well as other tools in he same class: "Hawk", U.S. Pat. No. 3,790, 201,1974; "Brush holder", U.S. Pat. No. 4,266,686, 1981; "Hawk having multi-position handle", U.S. Pat. No. 4,753,471, 1988.

Widely used mechanical method for spraying plastering material by compressed air performed by plaster-throwing machines (for example, the P13 type of the well-known German company "Putzmeister") leads to unnecessary stucco loss and requires a great volume of manual finishing along all the surface to be plastered.

The purpose of the proposed invention consists in providing high-quality and rather efficient plastering (with simultaneous spackling) for walls of the buildings and different inclined surface of industrial premises with relatively low efforts applied by workers using this kind of appliances.

At the same time, the proposed technical design allows for plastering the ceilings of buildings by means of the relatively lightweight device proposed when using the variant of manual mortar application on the surface to be treated, especially in its autonomous embodiment.

The variant of the device proposed with semi-automatic control is destined to reduce manual labor to a minimum and to increase the efficiency of the means applied with high quality of coating irrespective of human factor.

SUMMARY OF THE INVENTION

The purpose in hand is accomplished by the fact that the device for mortar applying on the workable surface of a building comprises a capacity for the mortar, a pump for transferring thereof, a high-pressure hose and a working organ; the latter consisting of at least one disc (rotating in an operational mode) and having perforations positioned primarily along smooth curves, passing through the disc center, and equipped with an electrical drive, and fixed in a stationary body; the latter being connected with the high pressure hose, supplying the mortar to the working capacity (formed by the rotating disc and the body). The mortar is squeezed through the device onto the workable surface, distributed on the surface, pressed and leveled centers of all the three working discs positioned in one plane, while two of them are rotating in one direction and the third—in the opposite direction.

The optimum design may include an additional mass of the working organ distributed non-uniformly in relation to the disc shaft (shafts), for example this mass may be formed by an eccentric (a boss), fixed on the disc shaft, rotating in the operational mode. This embodiment provides for vibration of the working organ for more even distribution of mortar on the workable surface of a building.

The device is, as a rule, completed with a set of detachable movable discs with different perforation diameters corresponding to the prearranged parameters of mortar, for example, its consistency.

The device is usually completed with a set of detachable units for connecting the body with the high-pressure hose (mostly, connecting pipes), corresponding to the given parameters of mortar, for example, its consistency.

In one of the perspective embodiments, the working unit of the device is fixed on an collapsible support (for example on a telescopic sag), attached on the other side to the common mobile base with the capacities, the hoses, and a unit for a chosen hose connection according to the predetermined technological process and a means for mortar pumping. Whereby the working organ can travel along the specially shaped guides. In some cases the said guides can be supported by two extensible supports.

According to the second basic embodiment, the working organ of the device is made in the form of a disc rotating in the operational mode and having a cutter plate positioned at a predetermined angle to its surface. In this case, the disc equipped with an electric drive is positioned in a stationary body connected to a high-pressure hose for supplying the mortar to the working space of the body, the mortar being squeezed onto the workable surface, with its simultaneous distribution, pressing and leveling by the working organ.

One of two capacities of the common mobile base having smaller volume is connected at the outlet to the high-pressure hose, and at the inlet with capacity of larger volume, the latter being made as a device for mortar mixture preparation (mortar mixing device).

The mortar mixing device comprises a chamber predominantly made in the shape of a truncated cone,

- having jet forming deflecting elements on the inner surface,
- having disc rotor with working and protective blades, rotated by a motor, placed on the chamber upper cover,
- whereby a guard ring for preventing the accumulation of mortar solid components in an unfavorable zone near the chamber foundation is installed in the inner volume of the chamber under the rotor disc,
- and a unit for initial mortar components is provided for in the upper part of the chamber, and a device for periodic mortar delivery is positioned in the chamber foundation.

This design of the mortar mixing device provides for the desired high quality of the mortar ready for being applied on a workable surface of a building.

In necessary cases the mortar mixing device chamber can be equipped with a branch pipe for continuous mortar extraction in its upper part.

In the embodiment with semi-automatic control the device proposed comprises:

- a mobile base with main equipment and control panel,
- laser guidance unit (for controlled supports of the working organ for its positioning),
- remote control panel with a device for measuring thickness of the mortar applied.

In this embodiment of the device

- the working organ is connected to the movable base via controlled supports on the workable surface, block for mechanisms control is positioned on the mobile base, while the laser quidance unit and remote control panel mentioned are positioned outside the movable base.

Each of the four controlled supports with thrust cone is fixed on the movable frame having a transport carriage for the working organ, is equipped with autonomous electrical drive with control module, hereby the frame mentioned is connected to stationary carrying frame fitted with the hoist for movable frame and is rigidly fixed to the mobile base.

In each controlled support the following elements are positioned:

control module for electrical drive, infrared transmitting and receiving device ( with emitting light diode and photodiode), module of parametric photosensor for responding to the laser beam of the laser guidance unit, and general electronic part of optical sensors for all the controlled supports is situated outside one of the supports.

Hereby the main control blot for the device is made on the basis of a microprocessor, connected to control circuits (according to commands from remote control panel) for all the device mechanisms and controlling the position of the movable parts of mechanisms.

Thus, the technical solution proposed on the whole represents a device with moving operator or working organ moved according to operator commands and effectuated by electrical drive, as well as a mobile base with necessary elements placed on it for performing operations destined for providing qualitative coating of walls and other surfaces of buildings and/or constructions by mortar.

The analysis of the described technical design compared to the well-known existing devices confirms that the present device is not only innovative and useful, but is performed at the level of an invention (non-obvious for a specialist in the given filed).

BRIEF DESCRIPTION OF THE DRAWING

The invention is illustrated by drawings, where it is shown.

DESCRIPTION OF THE PREFERRED EMBODIMENTS

The proposed device for mortar applying on a workable surface of a building or a construction comprises in its basic embodiment a capacity for initial building material, a means for pumping thereof, a high-pressure hose and a working organ.

Figures 1A, 1B:
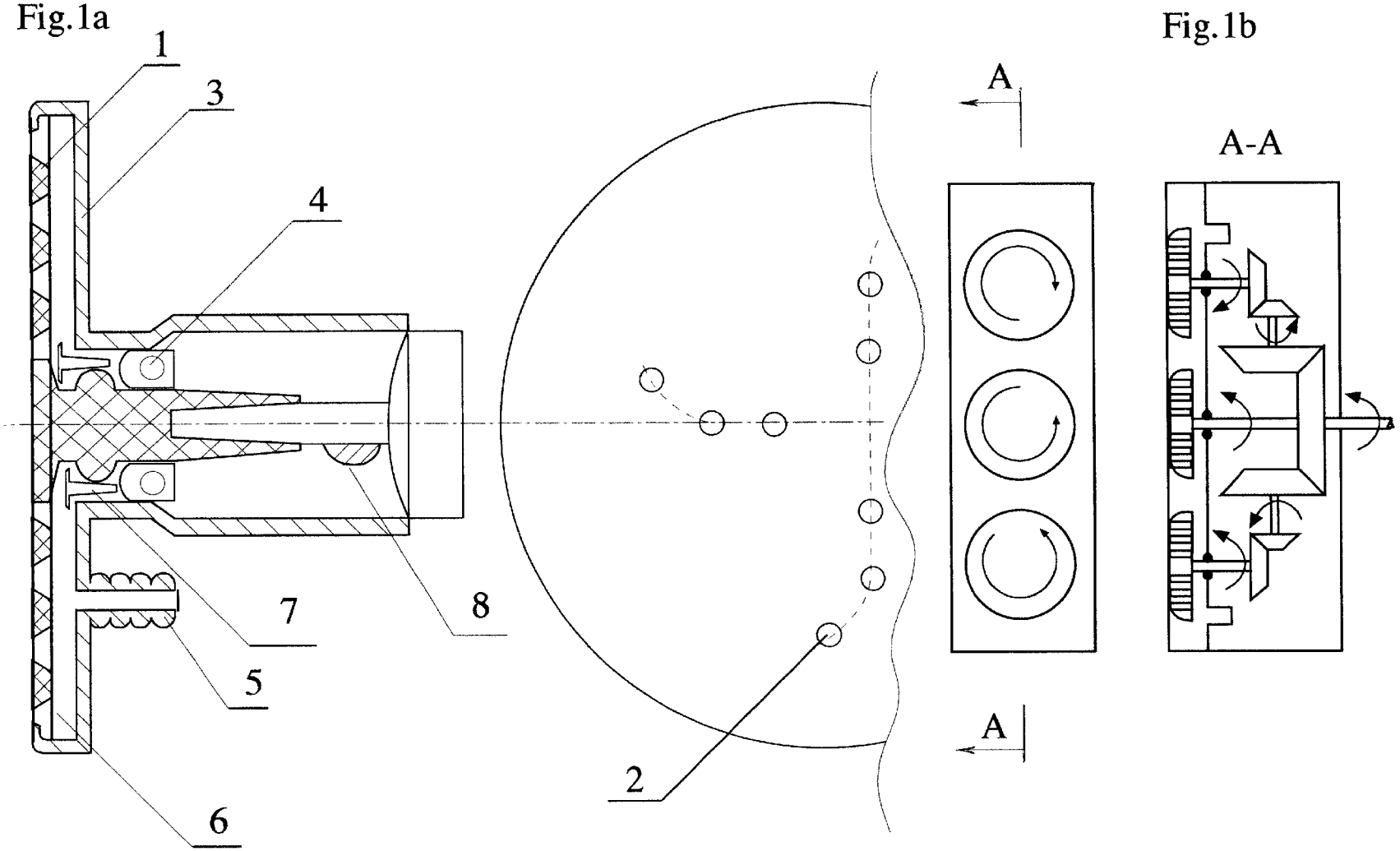
FIG. 1 —the first basic embodiment of the working organ ( a —one disc with perforations, b—three discs in one device)

This organ in its simplest embodiment is made of disc 1 rotating in the operational mode (FIG. 1) and having perforations 2, positioned mainly along smooth curves, passing through the disc's center. The above mentioned disc comprises an electrical drive (e.g. on basis of a motor of a low-speed drill) and is fixed in stationary body 3 with a possibility of rotating in bearing 4. The above mentioned body 3 through connecting pipe 5 is connected to a high-pressure hose, delivering by means of a pump (similar to a concrete pump) the initial building material to working cavity 6, formed by body 3 and rotating disc 1.

In the process of operation the above mentioned material is squeezed out through the perforations of disc 1 onto the workable surface (particularly on the surface to be plastered) of a building. It is simultaneously distributed onto the surface, pressed and leveled, creating a finished surface of a building (construction).

Protection of bearing 4 from ingress of hard particles, which may occur in the initial materials, is carried out by gasket 7, for example, a packing gland.

The optimum embodiment of the device's working organ comprises three movable working discs (not shown on the supplemented drawings as it is clearly evident to a specialist) with conforming perforations on each disc. Thereby the positions of the centers of all the discs in one plane, as well as rotation of two discs in one direction and the third in the opposite direction is very important.

The optimum solution can have an additional mass 8 of the working organ distributed ununiformly in relation to the disc (discs) shaft, e.g. formed with an eccentric (a boss) fixed on the disc shaft in the operational mode. This design affords working organ vibration for more even distribution of mortar on a workable surface of a building or construction.

The device is usually completed with a set of detachable movable discs with disc perforations diameters corresponding to the given parameters of mortar, for example, its consistency and the size of solid particles. The device should be usually completed with a set of detachable units for connecting the body with the high-pressure hose (mostly connecting pipes) corresponding to the given parameter of mortar, for example, its consistency.

Figure 2:
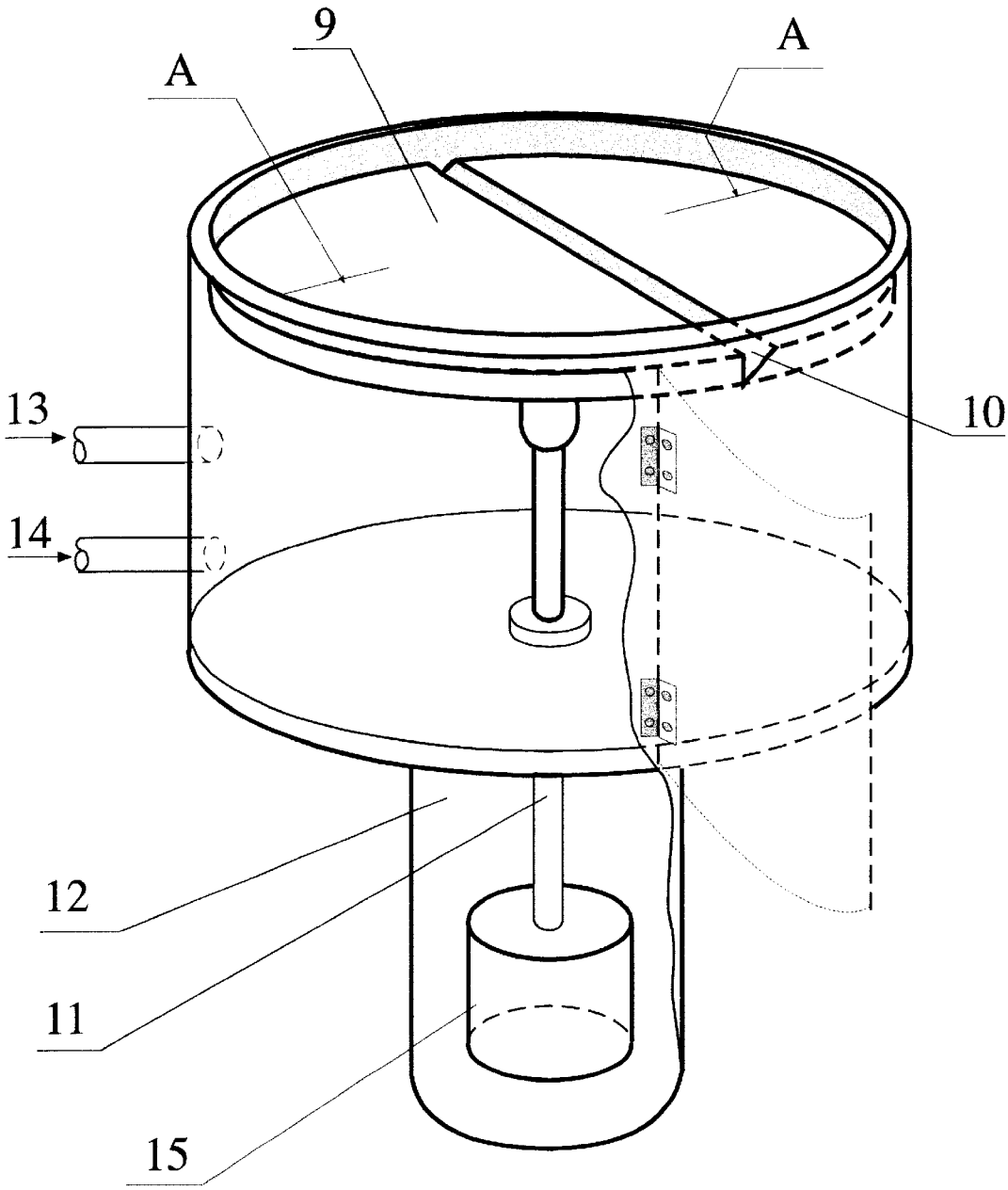
FIG. 2—the second basic embodiment (disc with cutter plate)
Figure 2:
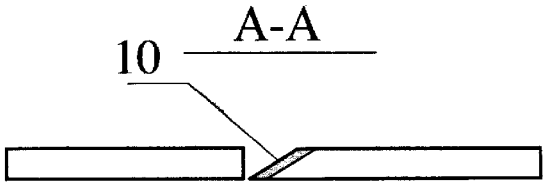

The second basic embodiment of the proposed device, which also contains a capacity for the initial building material, a means for pumping thereof, a high pressure hose and a working organ, primarily differs from the first basic embodiment in the design of the working organ (FIG. 2).

The latter is made of disc 9, rotating in the operational mode, with cutter plate 10, positioned at a given angle to the disc surface. The above-mentioned disc, set on a shaft (axis) 11 and having an electrical drive, is placed in a stationary cylindrical body 12. One section of the body is connected by means of connecting pipes with a water hose 13 (in particular for washing this section out), and high-pressure hose 14 for initial building material delivery to the working volume of the body. The building material is squeezed onto the workable surface, distributed on it, pressed and leveled by the working organ—a disc with a cutter blade (cutter blades).

Electrical motor 15, activating the working organ (disc), is placed in another section of the body, which is hermetically sealed from the first section. Section with an electric motor has smaller diameter so that the operator can easily hold the working organ in this part. Each section has an individual cover for access.

Figures 3A, 3B:
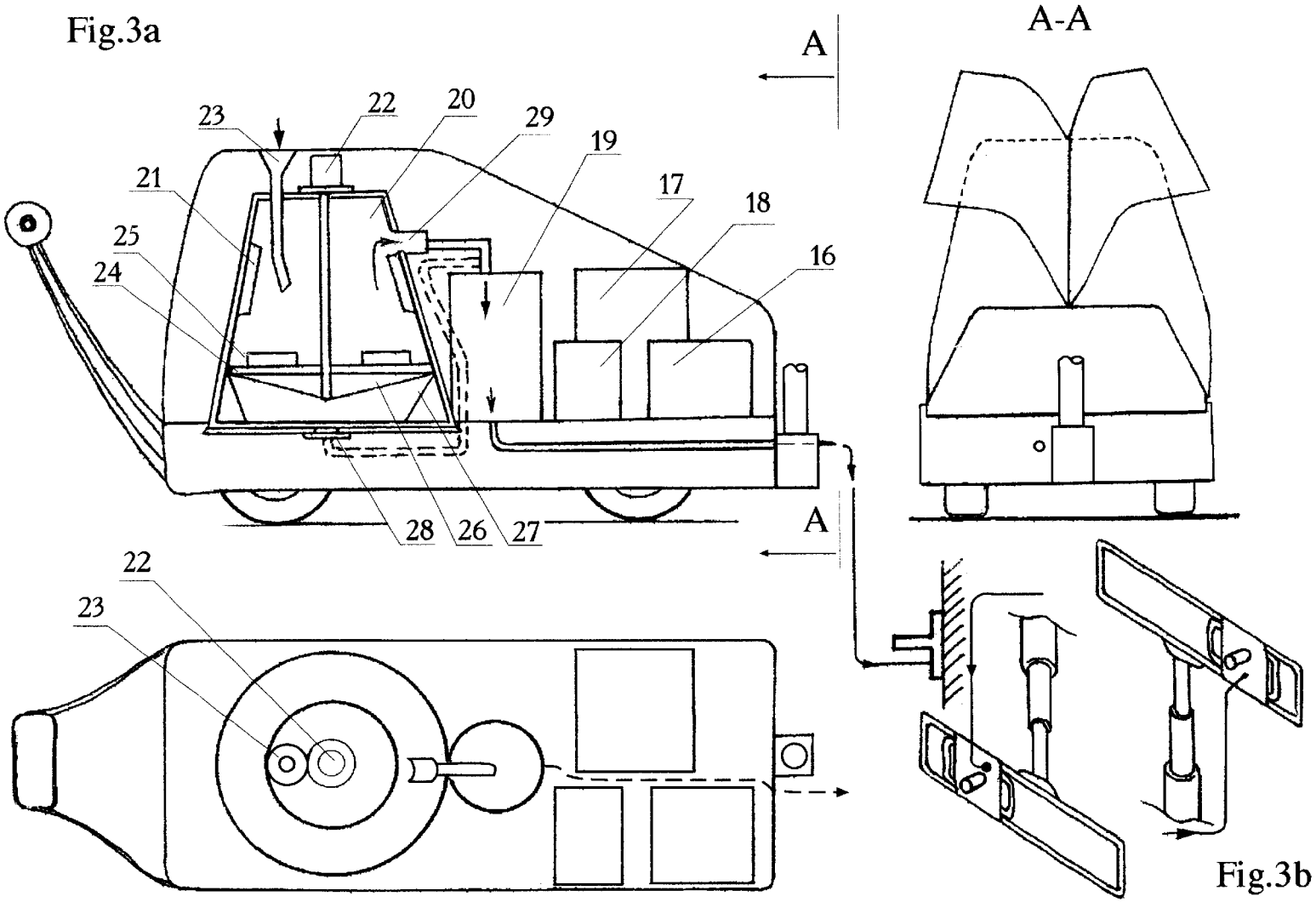
FIG. 3—the schematic representation of the mobile base with mortar mixing device and other elements placed on it (a—with typical positioning of the working organ on a workable surface, b—with the working organ fixed on a telescopic support in the guides of a special frame)

Appropriate hermetic seals are also provided in the given design. In the mobile base modification described (FIG. 3*a*) positioning of accumulator (or a unit for connection to a supply line) 16, set 17 of detachable movable discs and detachable units for connecting the working organ body with the high-pressure hose, compressor 18, small volume capacity 19 (up to 8 litres) and larger volume capacity 20 (up to 30 litres), made in the form of a device for mortar mixing (mortar mixing device) is being provided for.

Small volume capacity 19 is calculated for operator activity during 2–4 hours, mortar mixing device - for preparing mortar sufficient for operator activities during 1–2 days.

Chamber of the mortar mixing device is made in the form of a hollow truncated cone, with jet forming deflecting elements 21 being placed on its inner surface.

The upper detachable chamber cover serves as a base for mounting motor 22 (an electric motor in particular) and unit 23 for loading of mortar initial components (a loading branch pipe in particular).

High speed motor (1500–3000 rpm.; power determined by the ratio 20–30 W per 1 litre of the chamber volume) is intended for rotating the rotor, representing flat disc 24 with special shape working blades 25 installed on the disc upper plane. Protective blades 26 preventing mortar stagnation under the rotor are mounted on the disc lower plate.

Protective ring 27 prevents mortar solid components accumulation in an unfavorable zone near the chamber base, thus enhancing the conditions of the mortar speed-up.

Element 28 is intended for the prepared mortar delivery with periodic mode of mortar mixing device operation.

In case of continues mortar delivery, element 29 (branch pipe for continues mortar delivery) is placed in the upper part of the chamber.

During the mortar mixing device operation, mixing of the initial mixture components takes place as a result of mixture jets collision , with jets descending from deflecting elements 21 during rotor rotation).

The efficiency of the process is such that the mixture reaching upper zone of the mixing chamber is suitable for application.

This allows (if necessary) to realize a continues process "loading-preparation-mixture delivery".

The main advantages of the proposed device for mortar mixture preparation relate to its efficiency and high crushing ability of the process, due to which preliminary sorting of the solid components for rejection of impermissible large-sized particles becomes unnecessary.

And finally, it is necessary to note that the working organ of the proposed device can be fixed (in the operational mode) on the collapsible support (for example, on a telescopic sag) attached on the other side to the described mobile base (FIG. 3*b*); hereby the working organ can move along the specially shaped guides (for providing a more uniform pressing of the working organ to the workable surface and decreasing the operator's great effort).

In some cases, supporting of the said guides with two extensible supports is efficient for better stability of the device.

Development of the device providing for higher productivity with simultaneous decrease in operator's physical efforts seems to be rather perspective.

Such a device for mortar application on a workable surface in a variant with semi-automatic control includes:

"plaster-throwing machine" with main equipment and control panel, laser quidance unit (for working organ supports for their positioning), remote control panel with a ruler-feeler (gauge for measuring thickness of the mortar applied).

Basic part of the plaster-throwing machine in the definite variant described (FIG. 4, 10) is represented by a mobile base where capacity 20 for initial building material mixing with water (in the variant chosen a mixing chamber with auger-mixer), a means for the mixture pumping (pump 30, driven by electrical motor 31) for mortar delivery to the working organ by means of flexible hose 32 are mounted.

Changeable working organ can be used in two modifications:

a disc type one destined preferrably for walls spackling (like that described earlier in FIG. 1), a vibration-pressing one—for mortar application on the workable surface.

The specific feature of the vibration-pressing working organ consists in its being used for joint action of the motor vibration and pressing, where mortar is continuously (during installation operation) pumped into the hose for coating application on the wall surface.

Such a working organ, positioned under vibrator 33 in particular, (FIGS.4,5,11) has a working strip 34 (with slot 35 for mortar passing through) with smoothing strip 36 being situated nearby and having the possibility to displace its surface (rubber in particular) relative to the surface of the working strip. #37 is a limiting frame of the working organ.

The working organ is fixed on transportation carriage 38 (FIG. 4) moving in the guides of frame 39 (having the ability to move relative to supporting frame 40 serving the base for the hoist represented by a winch with electrical drive).

Figure 6:
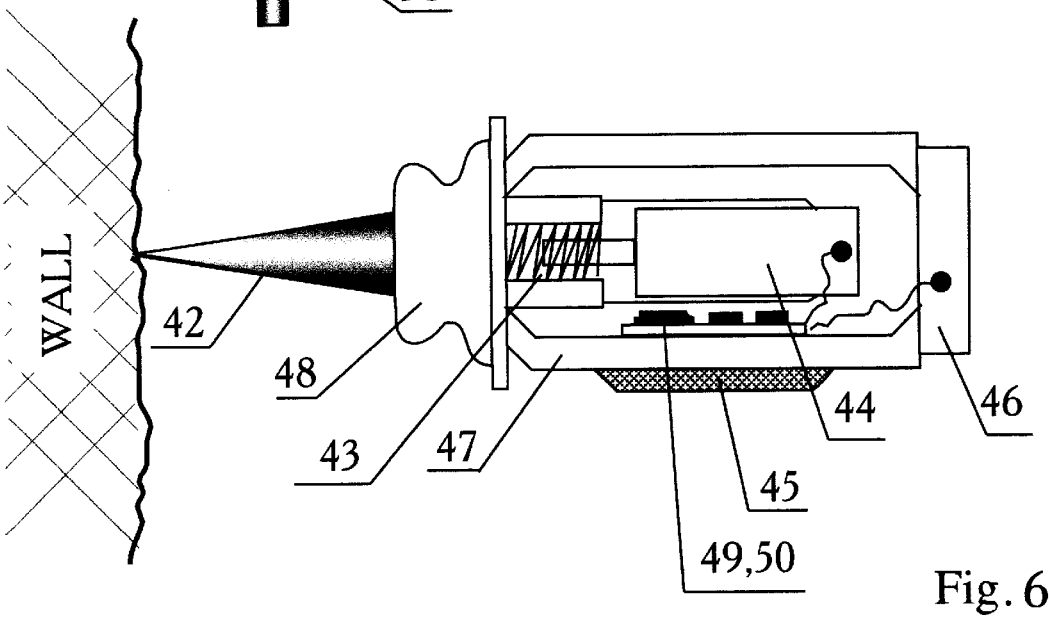
FIG. 6—schematic view of the working organ controlled support (in section)
Figure 7:
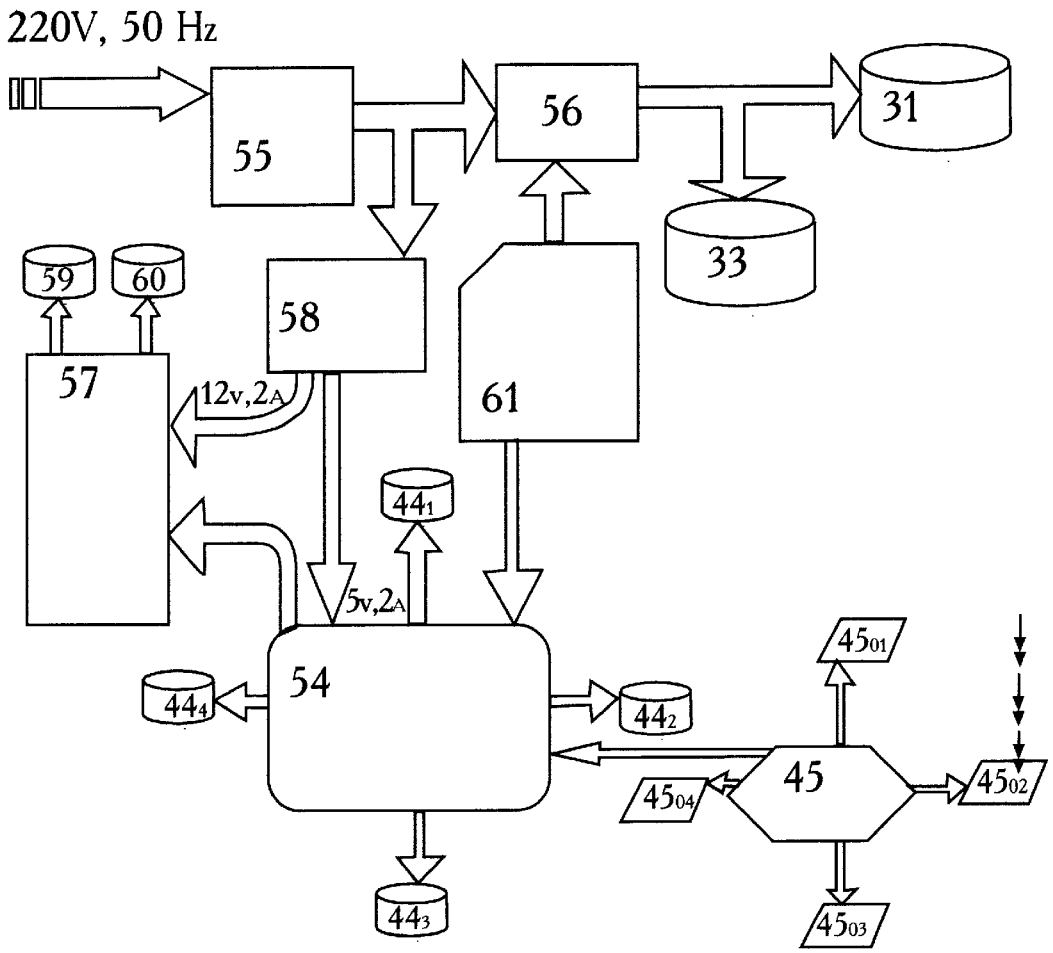
FIG. 7—structural scheme of the electrical part of the plaster-throwing machine itself.

Four controlled supports $\mathbf{41}_1$–$\mathbf{41}_4$ serving for frame leveling and the applied mortar thickness setting up are fixed in the corners of frame 39. Each controlled support (FIG. 6) consists of thrust cone 42 connected to pair screw-nut 43, drive 44 (any d.c.motor with reduction gear from the group $\mathbf{44}_1$–$\mathbf{44}_4$ in FIG. 7), control module (any optical gauge from the group $\mathbf{45}_{01}$–$\mathbf{45}_{04}$ in FIG. 7), accumulator 46 in FIG. 6 and protective housings (rigid 47, flexible 48). (Instead of an accumulator power source for connecting to the network 220V/50 Hz/60 Hz can be used instead of an accumulator).

In each controlled support there are located: drive control module 44, infrared receiver-transmitter 49 (comprising emitting light diode and photodiode), module 50 of parametric photosensor (in the form of photodiode ruler) for reacting to the laser beam of the laser guiding unit.

Frame 39 (FIG. 4) with controlled supports (and carriage 38 with the working organ) is connected to a carrying frame 40 with guides providing for the possibility of frame 38 with the carriage being lifted up to the working height. Clamps $\mathbf{51}_1$–$\mathbf{51}_4$ for the working organ clamping to the workable surface (wall).are positioned between the said frames.

Plaster-throwing machine (PTM) besides big transport wheels $52_1$, $52_2$ is equipped with small transport wheels $53_1$, $53_2$ for PTM moving along the workable surface.

Control block 54 (FIG. 7) is located on the mobile base. Block 54 serves for

- starting the pump (with electrical motor 31 connected to the a.c.network through automatic cut-out 55 by means of a magnetic starter in power relay block 56),
- and by means of low voltage relay 57 (from low voltage source 58) motors 59 for carriage displacement with vibrator 33 of the working organ (FIG. 5)
- and motor 60 of the hoist (winch) of the frame 39 (FIG. 1); thus providing for emergency situations functioning.

The block main part is represented by a microprocessor providing for motor end gauges control, serving the pump motor and carriage displacement motor relays switching on according to the command from control panel 61 (FIG. 4,7) mounted on the device or from the remote control panel 62 (FIGS.4, 9, 10, 11).

Laser guidance unit (LGU) (FIG. 8) is an obligatory element of the system embodiment described which serves for controlling the supports for determining the given position of the working organ (including setting up the mortar layer. thickness applied on the wall) by means of positioning the controlled supports in the vertical plane.

LGU (mounted on a tripod) comprises:

- level 62 (bubble one in particular), providing for the LGU vertical and horizontal position,
- mechanical positioning device with three degrees of freedom, providing for the solid laser beam displacement in space and mounted on special guides mechanically connected (by means of screw pairs) to the motors for laser displacement,
- electronic control device providing for commands receival from the remote control panel and signals on carriages displacement for mechanical positioning device.

Leveling device for LGU is represented by a flask filled in with glycerine. Air bubble in the flask permits to control the LGU position in space (vertical and horizontal axes).

Mechanical positioning device provides for displacement in horizontal plane based on two coordinates of the LGU moving part and laser beam setting up at the necessary inclination angle for operation with the controlled supports. Mechanical positioning device comprises two carriages 63 for moving along two coordinates and declination mirror 64 (with the ability to be turned with the turning axis being perpendicular to the wall) for determining the laser beam inclination angle as well as limiting thrust-feeler 65. Laser beam displacement is provided by remotely controlled drives $66_1$–$66_4$ (step-by-step motors in particular) with angle displacement control.

Electronic device 67 for controlling LGU (FIG. 9) provides for receiving control commands from remote control panel, movement control and monitoring of laser head displacement. The device is made of two printed circuits (microprocessor printed circuit 67 and motors control printed circuit 68), accumulator 69 and a body. It is possible to install the power source for switching on to the network 220V/50 Hz/60 Hz.

Control is carried out by a 8-bit-slice microprocessor (#67 in FIG. 9), analogous to control bloc 54 (in FIG. 7) in its design (but differing in the inner operational algorithm).

Control for the mechanical positioner motors is carried out through the matching chip.

Laser beam guidance for the necessary angle is carried out by commands from the remote control panel and according to signals from the controlled support.

Setting up of the applied mortar thickness is carried out due to commands from the remote control panel 70 and by monitoring carriage 63 movement with the laser (displacement of laser head).

Connection between device 67 and drives $66_1$–$66_4$ for laser displacement is galvanic.

Electric supply of LGU is autonomous on the whole. Accumulator 69 (miniature one) gives corresponding voltages—5V and 12V for device 67 and motors for laser displacement (in the given plaster-throwing machine model [PTM]) respectively.

Remote control panel included into the complex of the means proposed is destined for controlling the whole device and coordination of activities.

Panel (FIG. 10) comprises measuring feeler (ruler-feeler) 71, gauge 72 for measuring the applied mortar thickness (optical gauge), keyboard (panel with keys itself) 73, emitter (transducer) 74 working in infrared range.

In the device modification described pump electric motor 31 is chosen to be of 3-phase a synchronous type, power 500W, voltage 380V, frequency 50 Hz.

Vibration-pressing working organ in the device model described is equipped with a drive having power 125W, voltage 220V, frequency 50 Hz.

It is natural that with series production of PTM for consumers in different countries and specifically for each group of consumers, the PTM would be completed with units having corresponding electrical parameters (in particular, pump motor can be made 1-phase for voltages 220V, 127, 110 V and frequencies 50 Hz or 60 Hz).

Low voltage power source 58 (FIG. 7) is galvanically connected with control bloc (control processor device) 54 and through low voltage relays 57 it is connected to hoist motors 59, 60 (and in the variant of controlled supports without accumulators it is also connected to motors $44_1$–$44_4$ of the supports with pickups schemes $45_{01}$–$45_{04}$ in supports).

Connecting wires (cables) are covered by casings and laid in special grooves on the PTM for preventing them from mechanical damage. Connecting (wires) cables leading to the working organ (i.e. to the moving unit of the PTM) are dressed in flexible metallic hoses.

Units (blocs) 56, 55, 58, 54, 57 and 45 (FIG. 7) are inside the control panel 61.

Figure 4A:
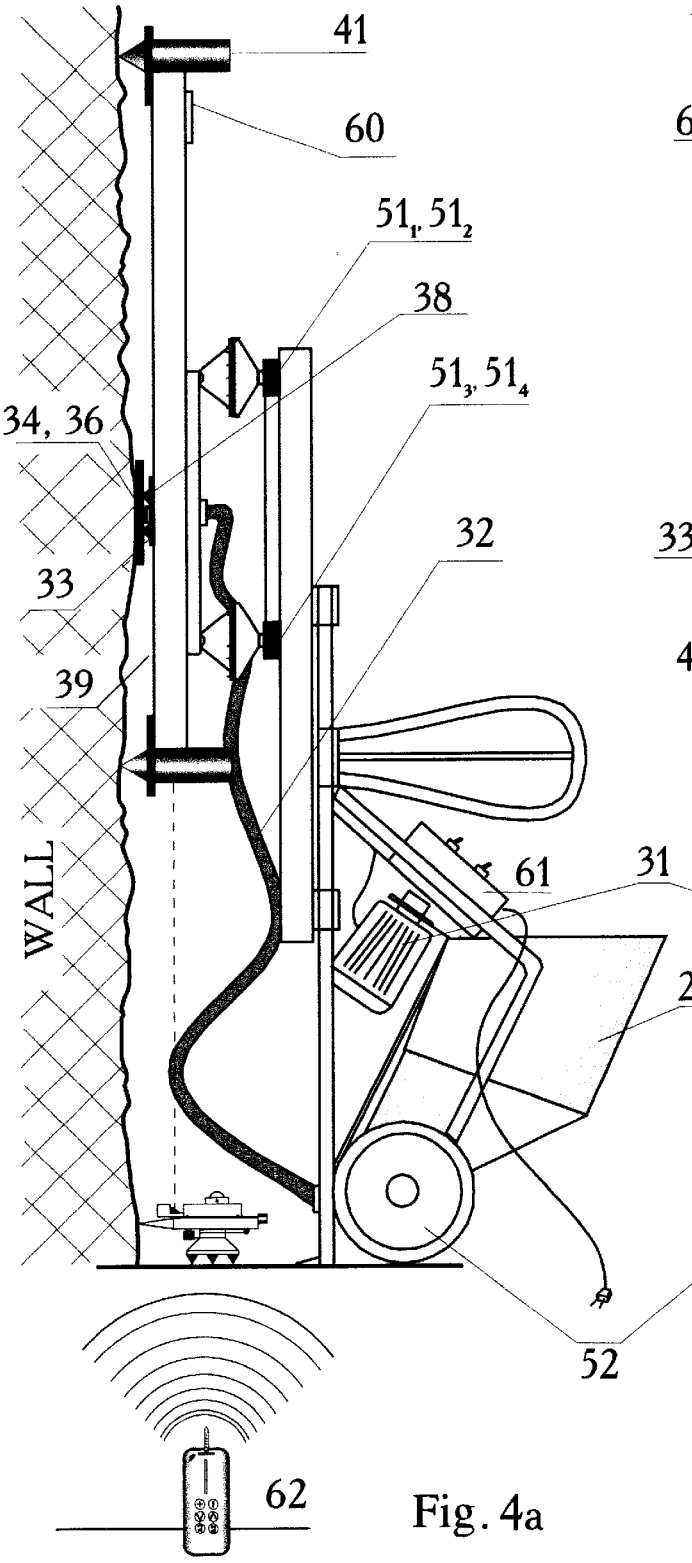
FIG. 4—device in the variant of the plaster-throwing machine with semi-automatic control (a—side view, b—view from the side of the working organ)
Figure 4B:
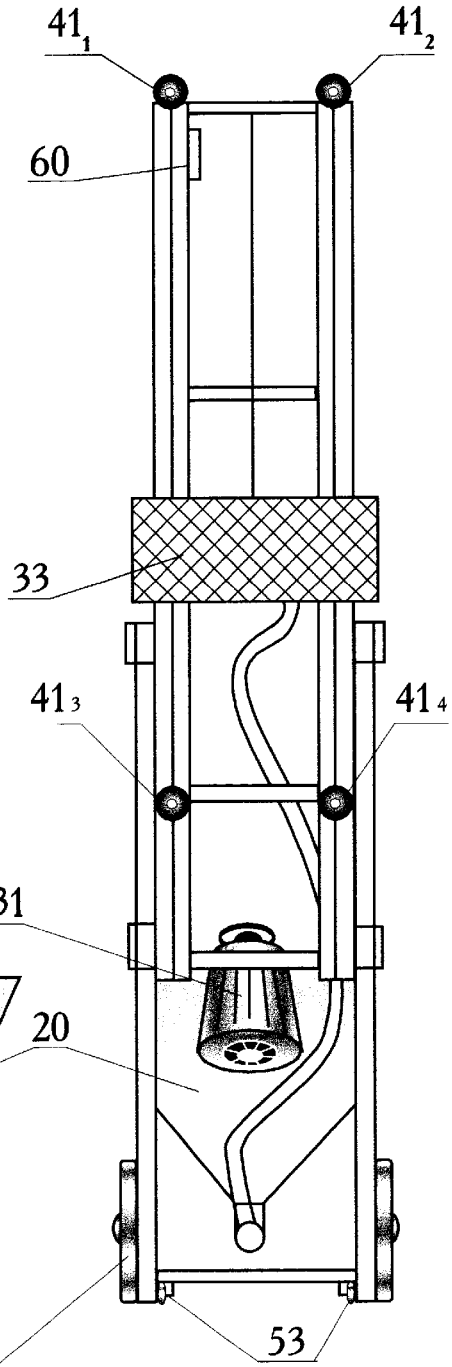
Figure 5:
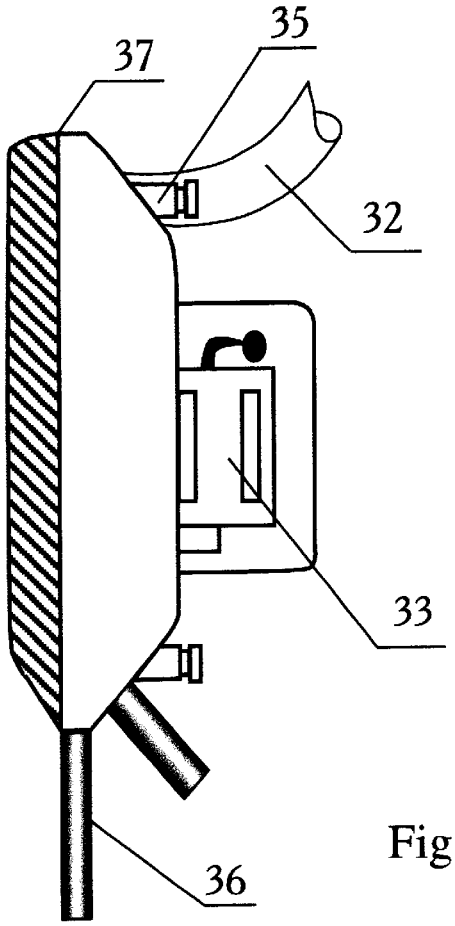
FIG. 5—embodiment of vibration-pressing working organ.

Units (blocs) $44_1$–$44_4$ and $45_{01}$–$45_{04}$ (FIG. 7) are positioned in four controlled supports $41_1$–$41_4$ (FIG. 4, 11).

Units 67, 68 and 69 as well as remotely controlled drives $66_1$–$66_4$ are situated inside the LGU.

Low voltage relay 57 is represented by relay with windings for 5V and contact groups for 2A. Hoist motor 59 of the working organ and PTM hoist motor 60 are identical (12V, small size collector motors with power 25W.).

Control bloc (processor control devices 54 (FIG. 7) is destined for monitoring motors $44_1$–$44_4$ of the working organ supports and responding to information from electronic circuit 45 of optical gauges $45_{01}$–$45_{04}$ in controlled supports of the working organ.

Processor of bloc 54 (in other words microcontroller—MC) constructively represents a printed circuit galvanically connecting the majority of controlled blocs.

In structural scheme (FIG. 7) these connections are shown in the form of arrows, their direction indicating the flow of control information (i.e. electrical signals).

Standard MC (like MC in the modem household electrical appliances) is equipped with key control panel 61 and built-in 4-signs indicator, thus providing the user (operator) with control means for the technological process.

MC working algorithms are introduced by a programmer when manufacturing MC.

The algorithm mentioned provides for the necessary technological operations on plaster applying on the workable surface (see further the description of the device operation).

For connecting with LGU device 54 includes an infrared transmitting light diode and receiving photodiode. This method of coupling is analogous to the operation of remote control panel for TV, i.e. by means of an encoded infrared radiation. This connection is necessary for interaction between PTM microcontroller (device 54) and LGU microcontroller (electronic control device 67).

The same infrared pair of elements exists correspondingly in LGU and remote control panel of plaster-throwing machine.

Optical gauges electronic circuit 45 in supports represents a uniting device for these gauges. This electronic device, which is constructively positioned outside, is situated near one of the supports, being a part of the MC actuators (due to the logics of structure elements interaction relay 55 and 57, support motors $\mathbf{44}_1$–$\mathbf{44}_4$ are to be listed among actuators of MC 54).

Optical gauges $\mathbf{45}_{01}$–$\mathbf{45}_{04}$ positioned in working organ supports are connected to the electronic circuit 45. They are represented by photodiode detectors of special design reacting to laser beam. This means that, when laser scanning beam touches the gauge (in any support), it transforms laser radiation into an electrical signal carrying information on support position relative to the surface (wall) to be plastered. This signal passes through device 45 to device 54 where it is processed by a processor. Connection with device 45 is galvanic.

Operation of the device (including its preparation for functioning) is as follows:

The proposed device is moved to the workable surface (wall), its controlled supports touching the surface.

Laser guidance unit (touching the surface by limiting thrust-feeler) is installed close to the same workable surface at the distance not less than 2 meters from the basic part of the device.

After having positioned the basic part of the device (i.e. plaster-throwing machine) and laser guidance unit an operator by means of a remote control panel tunes the LGU . Tuning includes: laser beam positioning parallel to the wall (surface), search for wall irregularities which is necessary for determination of optimum coating thickness (within the limits 2–10 mm).

Tuning is carried out in the following order:

The operator leans the remote control panel with the built-in feeler-measuring ruler against the wall and switches on the regime of laser beam position adjustment (FIG. 8–11).

LGU begins laser beam scanning (parallel to the wall) at the distance determined from the remote control panel (in this case a signal is given from remote control panel to the LGU, and from LGU laser beam enters the built-in optical gauge in remote control panel). Scanning makes it possible to get sure that there are no irregularities in the wall which cannot be covered by the given plaster thickness.

Figure 8:
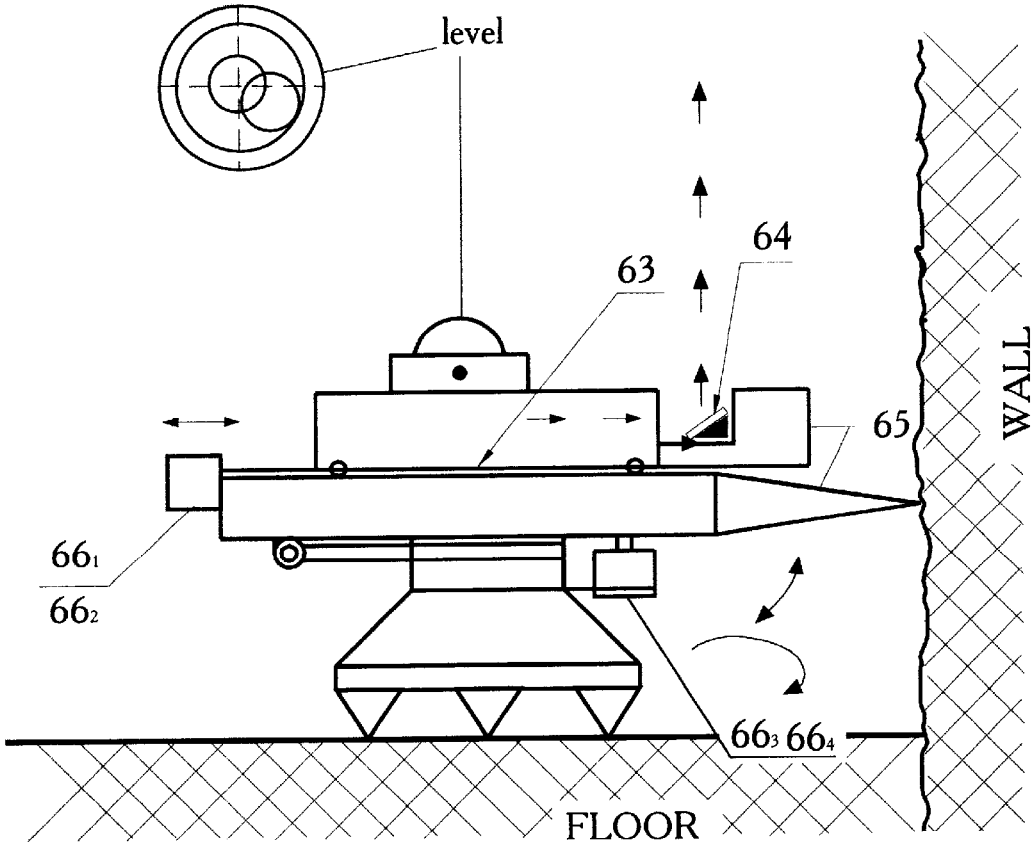
FIG. 8—schematical view of the laser guidance unit (LGU)
Figure 9:
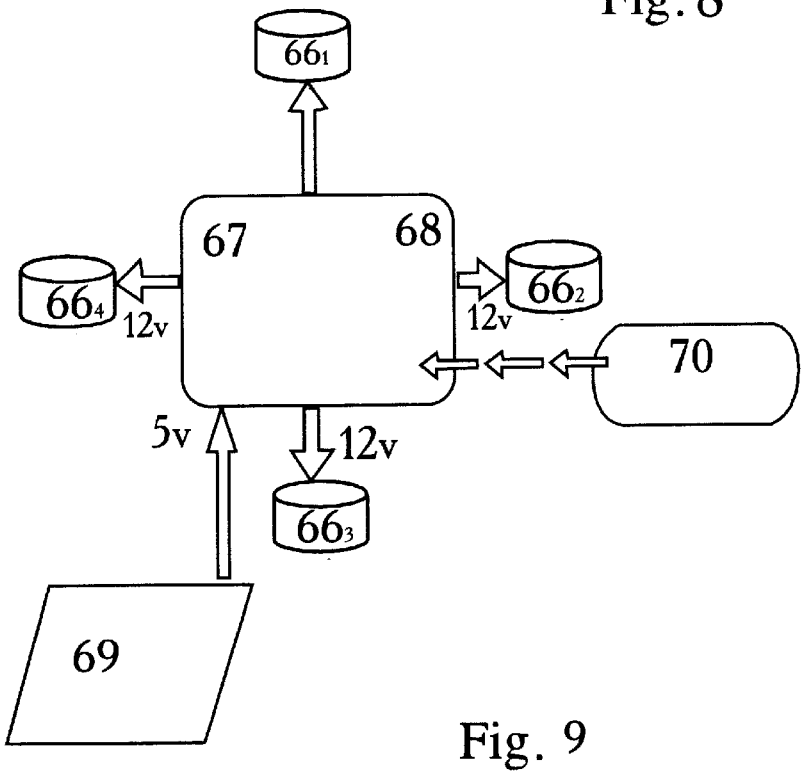
FIG. 9—structural scheme of LGU electrical part.
Figure 10:
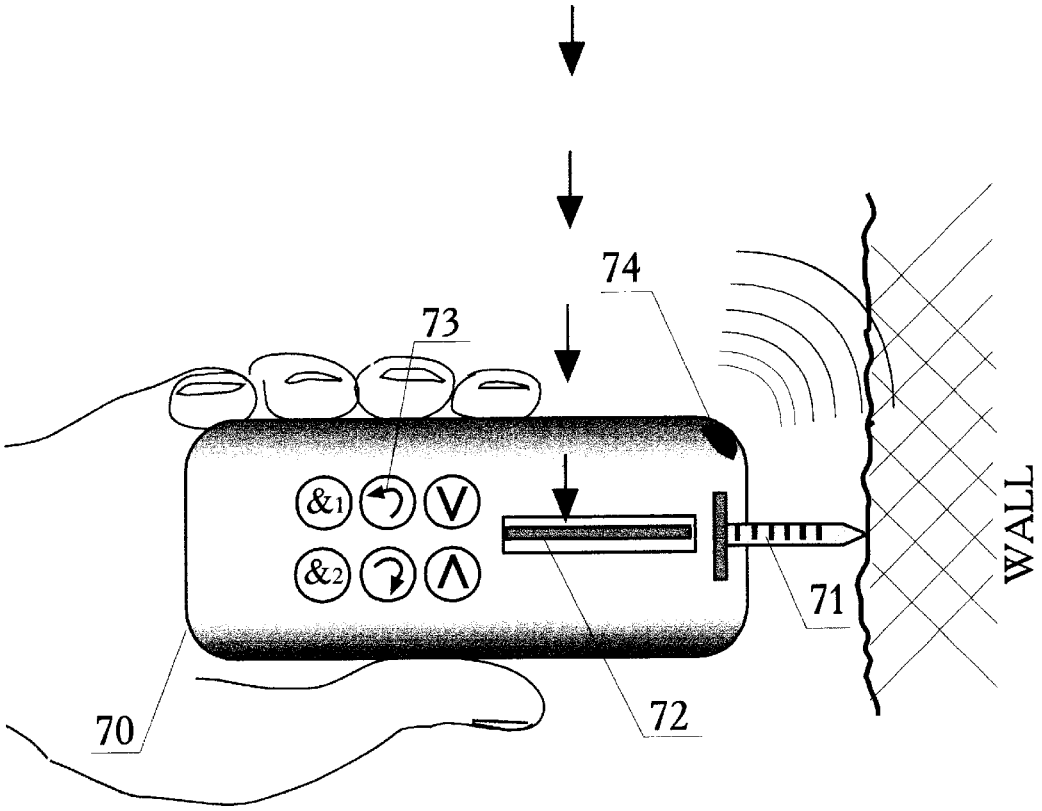
FIG. 10—remote control panel.
Figure 11:
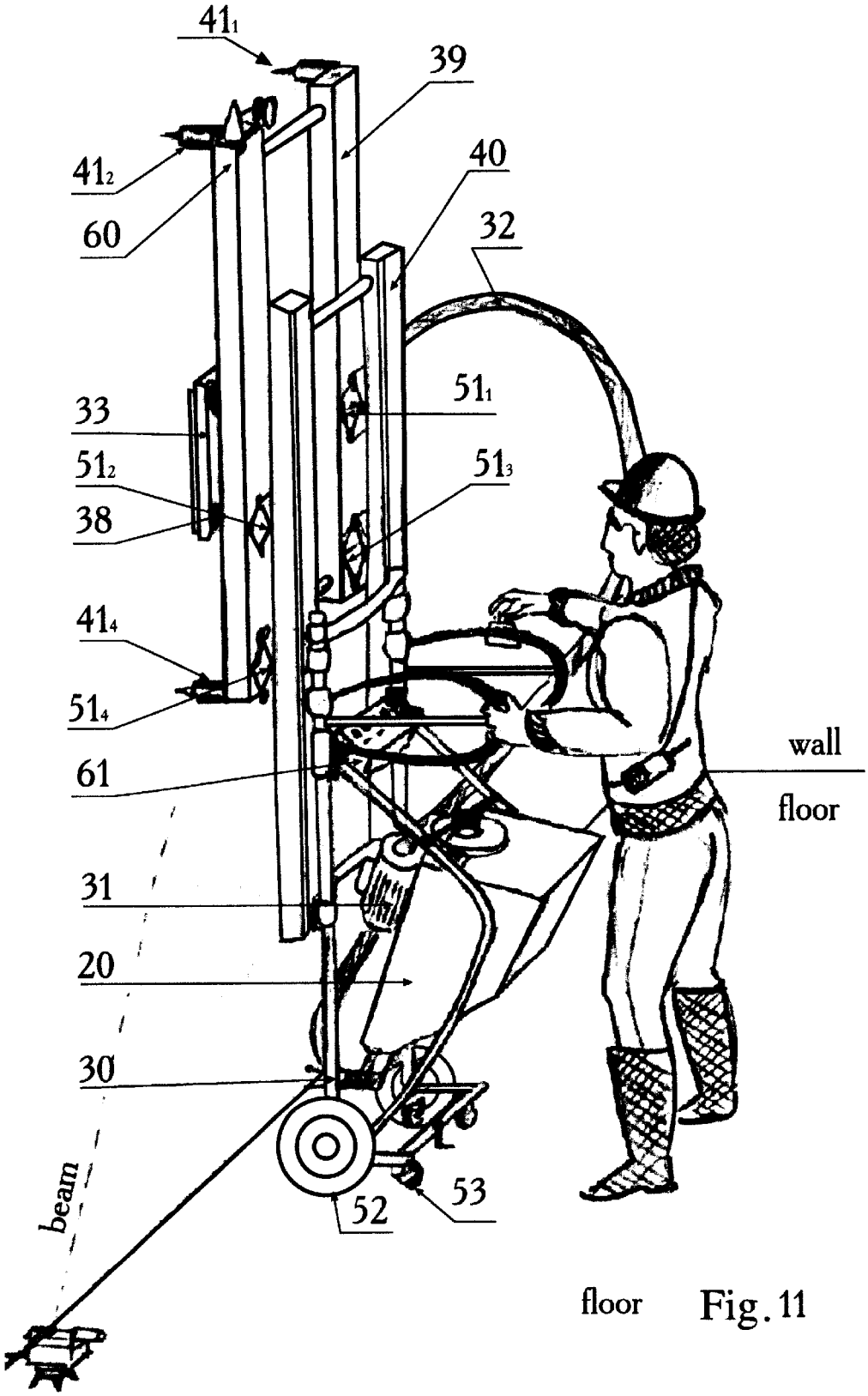
FIG. 11—general view of the device in the embodiment of plaster-throwing machine with semi-automatic control.

Then LGU guides the laser beam onto each of the controlled supports in turn (FIGS. 4, 8, 11). Supports set up the positions of the working organ in accordance with the given plaster thickness.

After this the operator places a portion of prepared plaster (or dry initial material and water) into the pump loading chamber (or dry initial material and water is placed into the device for building material mixture preparation—mortar).

Working organ in this case is in its extreme (e.g. lower) position.

The operator switches the PTM onto the power source and pushes the key "network" on panel 61 (FIG. 4, 7, 11).

A.c. power source voltage (network voltage) is delivered to power relays 56 (elecromagnetic starters) along power cable via automatic safety device 55 (FIG. 7), and pump motor 31 and working organ vibrator 33 are started by means of these relays and according to command from control panel 61.

Network voltage is also delivered to low voltage power source 58 which gives the following voltages:

12V (2A) for low-voltage relay 57 for working organ hoist motor 59 and PTM hoist motor 60;

5V (2A) for control block 54 and (in the variant of supports without accumulators) via it to controlled supports motors $\mathbf{44}_1$–$\mathbf{44}_4$ and optical gauges $\mathbf{45}_{01}$–$\mathbf{45}_{04}$ in the said supports of the working organ. When switching the pump on mortar enters the working organ via a high pressure hose. Carriage drive is being switched on, and the working organ begins to move (from down up in particular) along the guides applying (a uniform layer) of the mortar. (For working organ displacement an electrical hoist—winch is being used. Operator regulates the speed of the hoist by means of speed regulator on the device panel (depending on the thickness of mortar coating applied). Working organ treats the corresponding surface zone, in particular having width 250 mm and up to 2500 mm along the vertical.

When using vibration-pressing working organ, the mortar going out of the hose via slot 35 is diluted under the action of working strip 34 vibration and fills in all the irregularities, joints and fissures on the workable (plaster-coated) surface. Smoothing strip 36 finishes the surface to an acceptable roughness condition.

Surface worked out due to using high frequency vibration with low oscillations amplitude appears to be of a better quality when compared with the manual floating by a float; mortar large size grains (e.g. sand) are soaked into the layer applied (plaster layer), and smaller ones are distributed uniformly on the surface, thus creating a qualitative outer layer. Besides, vibration causes a considerable moisture seepage from the layer depth onto the surface, thus speeding up the process of applied mortar drying.

On finishing the treated zone part, the device is moved to the next uncovered zone, and the cycle is repeated.

Thus, in the variant with semi-automatic control, the device has the following advantages over the simplest designs operated manually.

First, mechanization with semi-automatic control for the process of mortar (plaster) applying on the workable surface decreases manual labour to its minimum.

As a consequence, more qualitative labour result (coating quality) is attained independent of the human factor (tiredness, general health, mood).

Secondly, application of laser guidance described also improves coating quality and shortens the technological cycle of plaster applying (taking into account monitoring for surface planeness, its quality and speed).

All this facilitates increase in labour productivity and, correspondingly, decrease in the number of workers employed.

Along with this, preliminary operator training for working with the installation is advisable (before starting the operation of a device with semi-automatic control).

I claim:

1. A device for mortar applying on a workable surface of a building, comprising a capacity for the mortar, a pump for transferring thereof, a high pressure hose and a working organ, wherein the working organ is made of at least one disc rotating in an operational mode, and having perforations positioned mainly along smooth curves, passing through the disc's center, which is equipped by an electrical drive and fixed in a stationary body, connected to the high pressure hose delivering into a working cavity, formed by the rotating disc and the body, the mortar, squeezed onto the workable surface with its simultaneous distribution on the surface, pressing and leveling, and the capacity for the mortar, the pump and the hose are placed on a mobile base.

2. The device according to claim 1, which contains at least two additional movable working discs with perforations, whereby the centers of all at least three working discs are positioned in one plane with two discs rotating in one direction and the third—in the opposite direction.

3. The device according to claim 1 or 2, which further comprises an eccentric boss fixed to the working organ disc shaft, said eccentric boss rotating in operational mode, which provides for vibration of the working organ for more even distribution of mortar on the workable surface of the building.

4. The device according to claim 1, further comprising a set of detachable movable discs with perforation diameters of each disc corresponding to the given parameters of mortar, a set of detachable units for connecting the body with the high pressure hose, corresponding to the given parameters of mortar.

5. The device according to claim 1, in which the working organ in its operational mode is mounted on an extensible support fixed on the other side to the mobile base.

6. The device according to claim 1, in which in the operational mode the working organ is mounted in the guides supported by two extensible supports fixed on the other side to the mobile base.

7. The device according to claim 1, which further on a mobile base is fitted with an additional capacity of smaller volume in relation to the main capacity, an outlet of the additional capacity is connected to the high pressure hose, and inlet is connected to the larger volume capacity, whereby the latter is made as a device for the mortar preparation, and comprises a chamber mainly in the shape of a truncated cone, having deflecting jet forming elements on an inner surface, and the disc rotor with working and protective blades in its inner volume, rotated by a motor placed on an upper cover of the chamber, whereby a guard ring is installed in the chamber inner volume for preventing mortar solid components accumulation in an unfavourable zone near the basis of the chamber, having a unit for loading of the initial mortar components in an upper part, and an element for periodic mortar extraction in the chamber foundation, that provides the desired quality of the mortar, ready for applying on a workable surface of a building.

8. A device for mortar applying on a workable surface of a building, comprising a capacity for the mortar, a pump for transferring thereof, a high pressure hose and a working organ, wherein the working organ made of a disc, rotating in an operational mode, with a cutter plate positioned at a predetermined angle to the surface of the disc, whereby the disc, having an electric drive, is joined to a stationary body connected to the hose transferring the mortar to the body working cavity and squeezing it onto the workable surface with its simultaneous distribution on the workable surface, pressing and leveling, and the capacity for the mortar, the pump and the hose are placed on a mobile base.

9. A device for mortar applying on a workable surface of a building, comprising a mobile base with a capacity for mortar, a pump transferring thereof with an electrical drive, a high pressure hose and a working organ, wherein, the working organ is connected to the mobile base by means of controlled supports on the workable surface, a mobile base has a control block for mechanisms, laser guidance unit for the said controlled supports for setting the working organ position which is situated outside the mobile base as well as remote control panel with a gauge for applied mortar thickness measurement, each controlled support having a thrust cone fixed on a movable frame with a transport carriage for the working organ, an autonomous electric drive with control module, whereby the frame is connected to a stationary carrying frame fitted with a movable frame hoist and rigidly connected to the mobile base, here each controlled support comprises electrical drive control module, infrared range receiver-transmitter with emitting light diode and receiving photodiode, parametric photosensor module for responding to a laser beam of the laser guidance unit, and a general electronic part of optical gauges of all the controlled supports is positioned outside one of the supports.

10. The device according to claim 9, in which main control block is made on the basis of a microprocessor, coupled with control circuits by commands from the remote control panel for all the mechanism of the device and monitoring the position of mechanisms moving parts.

* * * * *